US009530592B1

(12) United States Patent
Blankemeyer

(10) Patent No.: US 9,530,592 B1
(45) Date of Patent: Dec. 27, 2016

(54) ARC EXTINGUISHING ASSEMBLIES AND METHODS

(71) Applicant: Siemens Aktiengesellschaft, München (DE)

(72) Inventor: Mark Blankemeyer, Suwanee, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/855,603

(22) Filed: Sep. 16, 2015

(51) Int. Cl.
*H01H 33/08* (2006.01)

(52) U.S. Cl.
CPC ..... *H01H 33/08* (2013.01); *H01H 2033/085* (2013.01)

(58) Field of Classification Search
CPC ..... H01H 9/36; H01H 9/342; H01H 73/18; H01H 9/346; H01H 9/362; H01H 9/443; H01H 9/46; H01H 33/08; H01H 33/596; H01H 9/302; H01H 9/34; H01H 9/345; H01H 50/546; H01H 9/446; H01H 1/20
See application file for complete search history.

(56) References Cited

U.S. PATENT DOCUMENTS 2,970,197 A 1/1961 Frink
4,831,347 A * 5/1989 Orosz ..... H01H 9/345 335/10
4,876,421 A * 10/1989 Miller ..... H01H 9/34 218/150
4,963,849 A * 10/1990 Kowalczyk ..... H01H 9/342 218/35
6,373,016 B2 4/2002 Brouillat et al.
2005/0263492 A1* 12/2005 McCoy ..... H01H 9/362 218/34
2011/0017709 A1* 1/2011 Prohaska ..... H01H 9/36 218/151
2012/0211469 A1* 8/2012 An ..... H01H 9/346 218/149
2015/0028973 A1 1/2015 Cardwell et al.
2015/0041436 A1 2/2015 Ferree
2015/0348720 A1* 12/2015 Smeltzer ..... H01H 9/34 218/151

FOREIGN PATENT DOCUMENTS

WO 2013130035 A1 9/2013

* cited by examiner

*Primary Examiner* — Truc Nguyen

(57) ABSTRACT

An arc extinguishing assembly for a circuit breaker or switch. The arc extinguishing assembly includes an arc chamber having an arc chamber width (b) adjacent to a contact arm tip of a contact arm, stacked arc plates located at a forward end of the arc chamber adjacent to the contact arm tip, and first and second fin features located at the forward end between the arc plates and the contact arm tip. The first fin feature including a first inner edge and the second fin feature including a second inner edge, wherein the first inner edge and the second inner edge are spaced apart from one another by a spacing distance (a), wherein a venturi ratio of a/b is equal to or less than 0.6. Contact assemblies for circuit breakers, arc chute assemblies, and methods of extinguishing and arc are disclosed, as are other aspects.

18 Claims, 9 Drawing Sheets

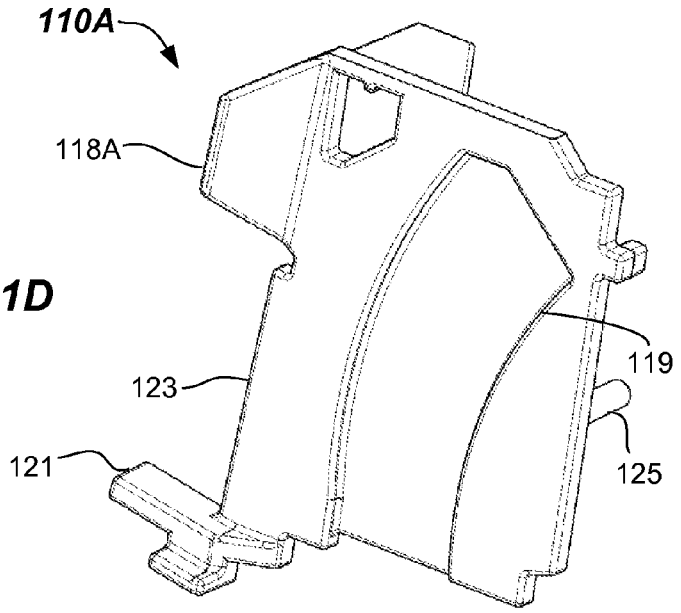
FIG. 1D
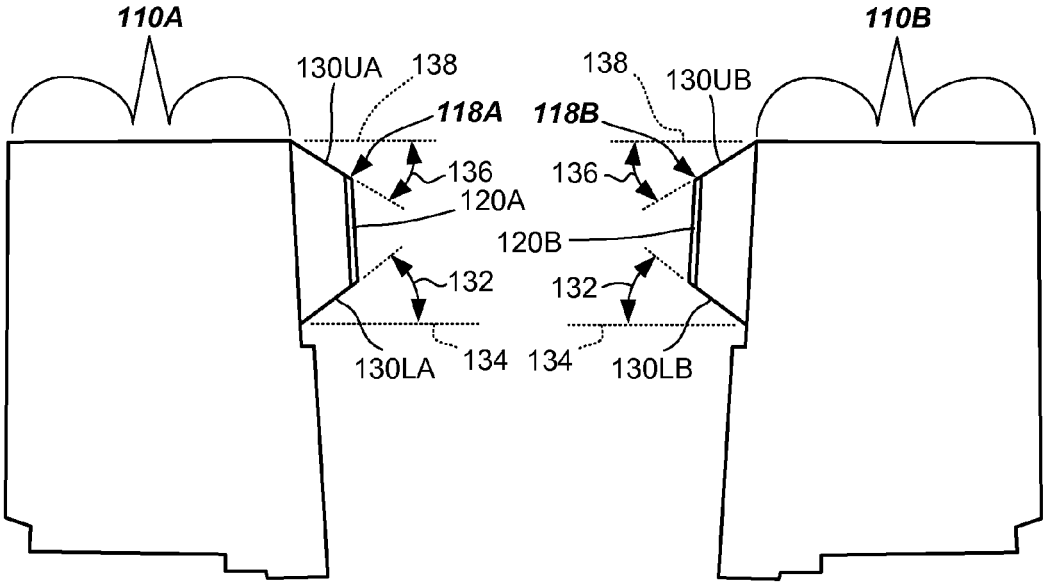
FIG. 1E
FIG. 1F

ARC EXTINGUISHING ASSEMBLIES AND METHODS

FIELD

The present invention relates generally to circuit breakers, and more particularly to arc extinguishing components for extinguishing arcs generated within circuit breakers.

BACKGROUND

Circuit breakers can include electrical contact assemblies, which may have multiple pivotable contact arms per electrical phase. The contact arms are intended to blow apart from the stationary electrical contact due to magnetic repulsive forces generated under very high short circuit conditions. Currently, not only is there a demand to decrease the relative size of existing circuit breakers, but also to further improve their interruption speed. It is desirable that such circuit breakers interrupt as quickly as possible in order to limit damage to the protected electrical equipment and also to prevent excessive contact erosion.

Arc chutes have been used in circuit breakers in order to increase interruption speed. Arc chutes typically include stacked metal arc plates, with the top plate usually including an arc horn, which wraps over a front of some of the upper arc plates in front of the arm tips of the pivotable contact arms. One feature that has been used to increase speed at which the arc is pushed into the arc plates is by using magnetic forces augmented through the use of a slot motor. However, at lower arc currents it becomes quite difficult to push the arc into the upper arc plates, which, as has been witnessed by the inventors, results in lower arc voltage across the circuit breaker and little or no erosion of the upper arc plates.

Thus, improved mechanisms adapted to be used in circuit breakers to improve arc extinguishing performance are sought.

SUMMARY

In a first embodiment, an arc extinguishing assembly is provided. The arc extinguishing assembly includes an arc chamber having an arc chamber width (b) adjacent to a contact arm tip of a contact arm, stacked arc plates located at a forward end of the arc chamber adjacent to the contact arm tip, and a first fin feature and a second fin feature located at the forward end between the arc plates and the contact arm tip, the first fin feature including a first inner edge and the second fin feature including a second inner edge, wherein the first inner edge and the second inner edge are spaced apart from one another by a spacing distance (a), wherein a venturi ratio of a/b is equal to or less than 0.6.

In yet another embodiment, an arc extinguishing assembly is provided. The arc extinguishing assembly includes an arc chamber having an arc chamber width (b) adjacent to a contact arm tip of a contact arm, stacked arc plates located at a forward end of the arc chamber adjacent to the contact arm tip, an arc horn located above the stacked arc plates, the arc horn including a tongue, a first outgassing spacer and a second outgassing spacer positioned on opposing sides of the arc chamber, and a first fin feature and a second fin feature located at the forward end between the arc plates and the contact arm tip and positioned at least partially behind the tongue, the first fin feature including first inner edge and the second fin feature including a second inner edge, wherein the first inner edge and the second inner edge are spaced apart from one another by a spacing distance (a), wherein a venturi ratio of a/b is equal to or less than 0.6, and wherein the first fin feature is integral with the first outgassing spacer and the second fin feature is integral with the second outgassing spacer.

In a method embodiment, a method of extinguishing an arc is provided. The method includes providing an arc chamber having an arc chamber width (b) adjacent to a contact arm tip of a contact arm, providing stacked arc plates located at a forward end of the arc chamber adjacent to the contact arm tip, providing a first fin feature and a second fin feature located at the forward end between the arc plates and the contact arm tip, the first fin feature including first inner edge and the second fin feature including a second inner edge, wherein the first inner edge and the second inner edge are spaced apart from one another by a spacing distance (a), wherein a venturi ratio of a/b is equal to or less than 0.6, and extinguishing the arc by passing gas through an opening between the first inner edge and the second inner edge to push the arc into the arc plates.

Still other aspects, features, and advantages of the present invention may be readily apparent from the following detailed description by illustrating a number of example embodiments and implementations, including the best mode contemplated for carrying out the present invention. The present invention may also be capable of different embodiments, and its details may be modified in various respects, all without departing from the scope of the present invention. The invention is to cover all modifications, equivalents, and alternatives falling within the scope of the claims.

BRIEF DESCRIPTION OF DRAWINGS

The drawings, described below, are for illustrative purposes only and are not necessarily drawn to scale. The drawings are not intended to limit the scope of the invention in any way. Wherever possible, the same or like reference numbers will be used throughout the drawings to refer to the same or like parts.

FIG. 1D illustrates an isometric view of an outgassing spacer of an arc extinguishing assembly including integral fin features according to one or more embodiments.

FIG. 1E illustrates a side plan view of a first outgassing spacer of an arc extinguishing assembly with an integral first fin feature according to one or more embodiments.

FIG. 1F illustrates a side plan view of a second outgassing spacer of an arc extinguishing assembly with an integral second fin feature according to one or more embodiments.

DESCRIPTION

Embodiments of an arc extinguishing assembly are useful in circuit breakers, such as in circuit breakers having one or more moveable contact arms, and ratings from 100 A-2000 A, including 160 A-1200 A, for example. However, the arc extinguishing assemblies described herein may be used in any suitable circuit breaker or switch component where better disbursement of the arc within the arc plates is desired. Embodiments of the arc extinguishing assembly are especially adapted for use in circuit breakers containing one or more contact assemblies having one or more contact arms that are intended to blow apart from a stationary contact due to magnetic repulsion forces generated under very high short circuit conditions. It is desirable that such circuit breakers have contact arms that blow apart extremely rapidly when exposed to such short circuit conditions.

In view of the foregoing difficulties, an inventive configuration of an arc extinguishing assembly, which may provide improved interruption speed, is provided. The arc extinguishing assemblies include an arc chamber having an arc chamber width (b) adjacent to a contact arm tip of a contact arm, stacked arc plates located at a forward end of the arc chamber adjacent to the contact arm tip, and a first fin feature and a second fin feature located at the forward end between the arc plates and the contact arm tip. The first fin feature includes a first inner edge and the second fin feature includes a second inner edge. The first inner edge and the second inner edge are spaced apart from one another by a spacing distance (a). The spacing distance (a) is set for a particular arc chamber design so as to produce a venturi ratio of a/b that is equal to or less than 0.6. This feature improves gas pressure and helps push the arc to the upper arc plates.

As will become apparent, the arc extinguishing assemblies described herein may advantageously allow circuit breakers into which they are received to interrupt an experienced short circuit condition more rapidly. Moreover, alternatively, inventive arc extinguishing assemblies may advantageously allow the circuit breaker into which it is received to be made physically smaller.

These and other embodiments of the arc extinguishing assemblies, contact assemblies including the arc extinguishing assemblies, arc chute assemblies, fin and support assemblies and methods of extinguishing an arc with an arc extinguishing assembly are described below with reference to FIGS. 1A-6.

Figure 1A:
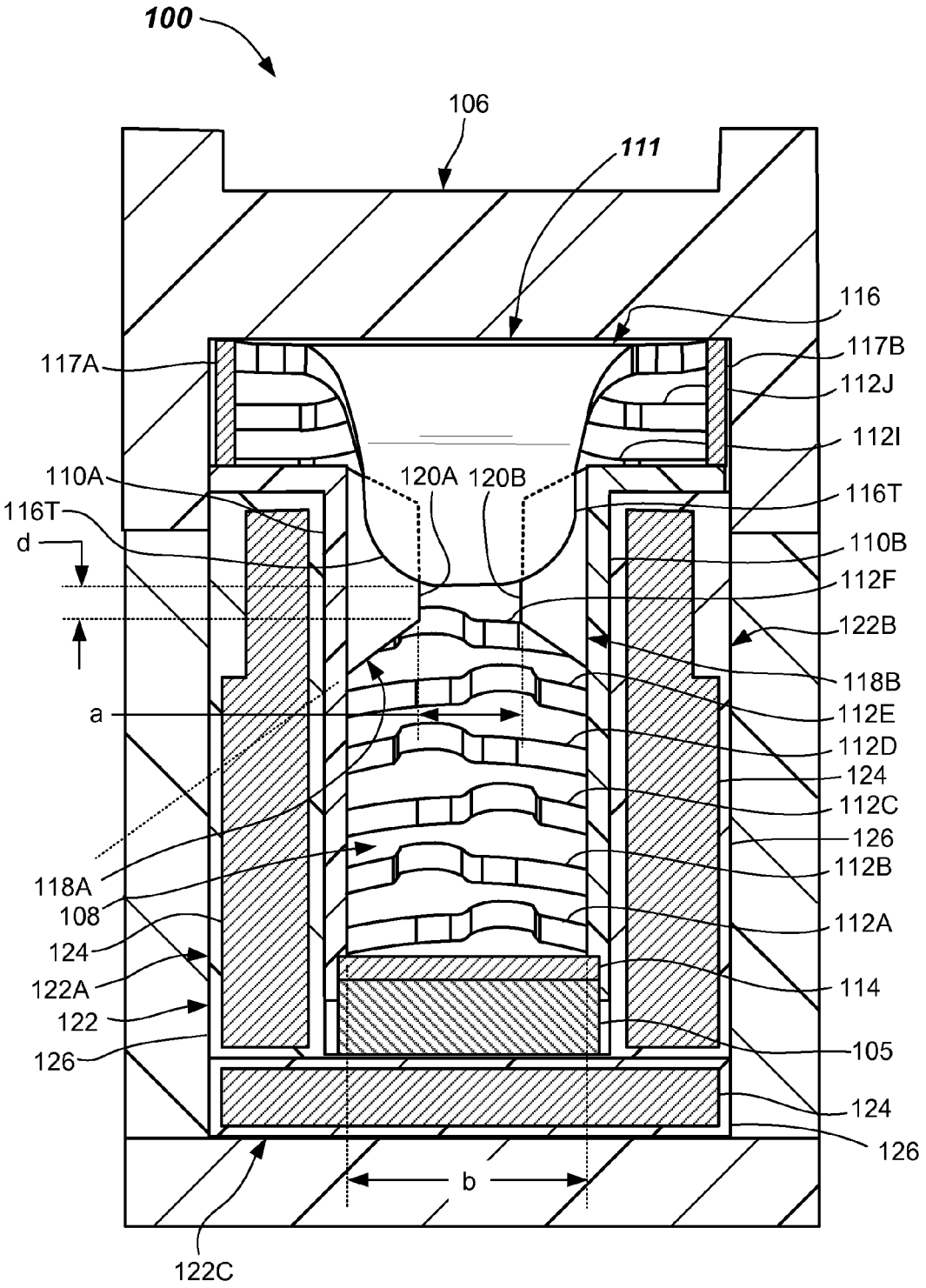
FIG. 1A illustrates a cross-sectioned partial front view of an arc extinguishing assembly including fin features and a slot motor according to one or more embodiments.
Figure 1B:
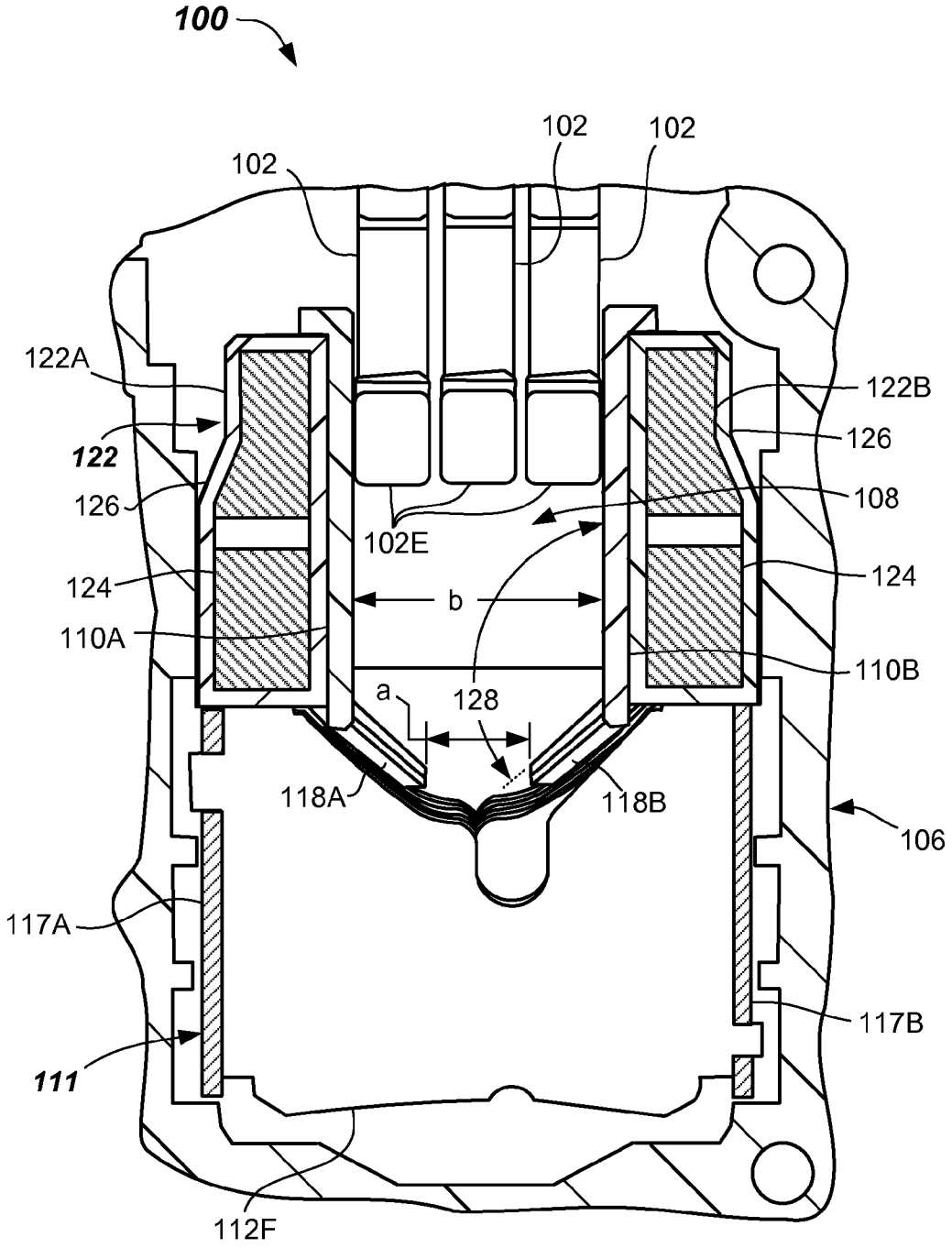
FIG. 1B illustrates a cross-sectioned partial top view of an arc extinguishing assembly including fin features and a slot motor according to one or more embodiments.
Figure 1C:
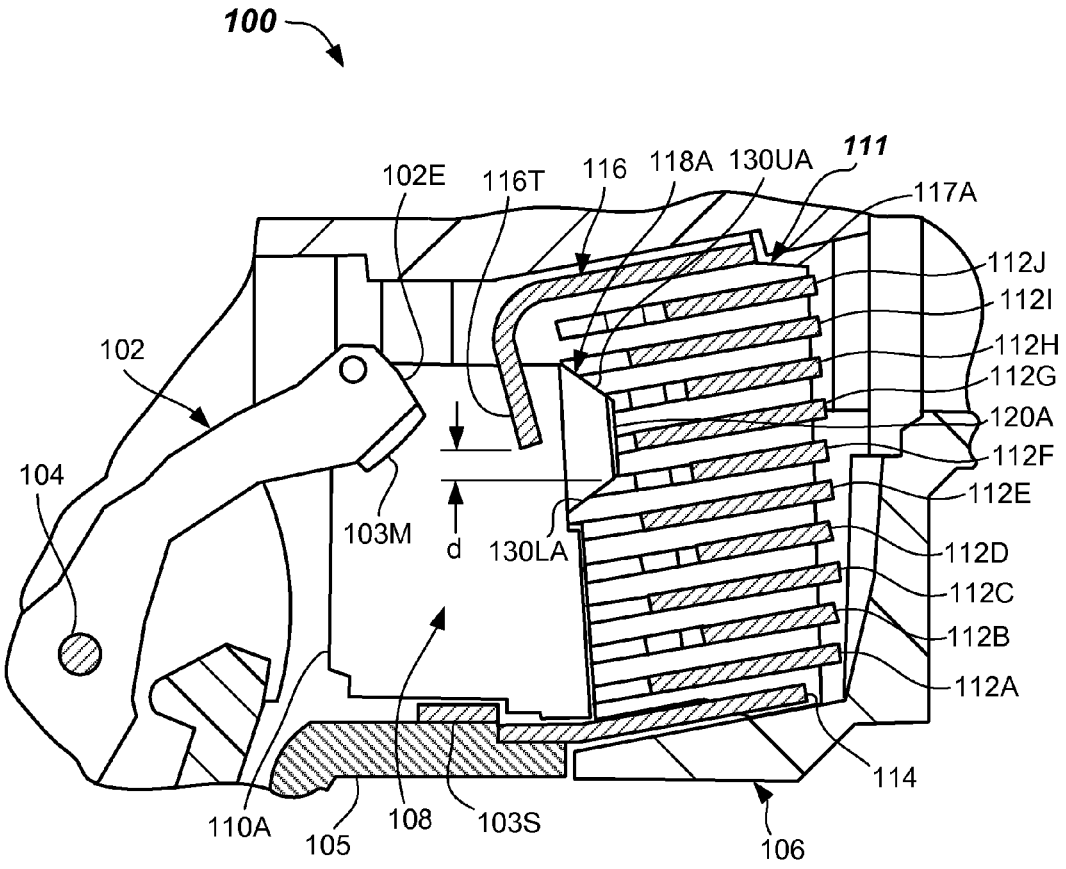
FIG. 1C illustrates a cross-sectioned partial side plan view of an arc extinguishing assembly including fin features and a slot motor according to one or more embodiments.

Referring now in specific detail to FIGS. 1A-1C, an arc extinguishing assembly 100 is shown. The arc extinguishing assembly 100 may be used in single pole circuit breaker or in a multi-pole circuit breaker having one or more contact arms 102 that pivot about one or more pivot pins 104 (FIG. 1C), for example. In some multi-contact arm embodiments, the contact arms 102 may pivot about a common pivot pin. The one or more contact arms 102 may each include a moving electrical contact 103M, whereas a stationary electrical contact 103S may be provided on a line side terminal 105. A common stationary contact 103S may be provided when more than one contact arm 102 is used. The other end of the contact arm 102 from the moving electrical contact 103M may be coupled to a load side conductor leading to a lead side terminal (not shown).

Arc extinguishing assembly 100 may further be included within a housing 106 of a circuit breaker, for example. Components of the arc extinguishing assembly 100 may reside in a pocket formed in the housing 106. Other arc extinguishing assemblies, like arc extinguishing assembly 100, may be installed in the housing 106, as well. For example, the arc extinguishing assemblies 100 may be installed in a circuit breaker, wherein each arc extinguishing assembly 100 may be dedicated to an electrical phase (e.g., A, B, C phases). Each arc extinguishing assembly 100 dedicated to each phase may include one, two, three, four, five or more contact arms 102.

Figure 1G:
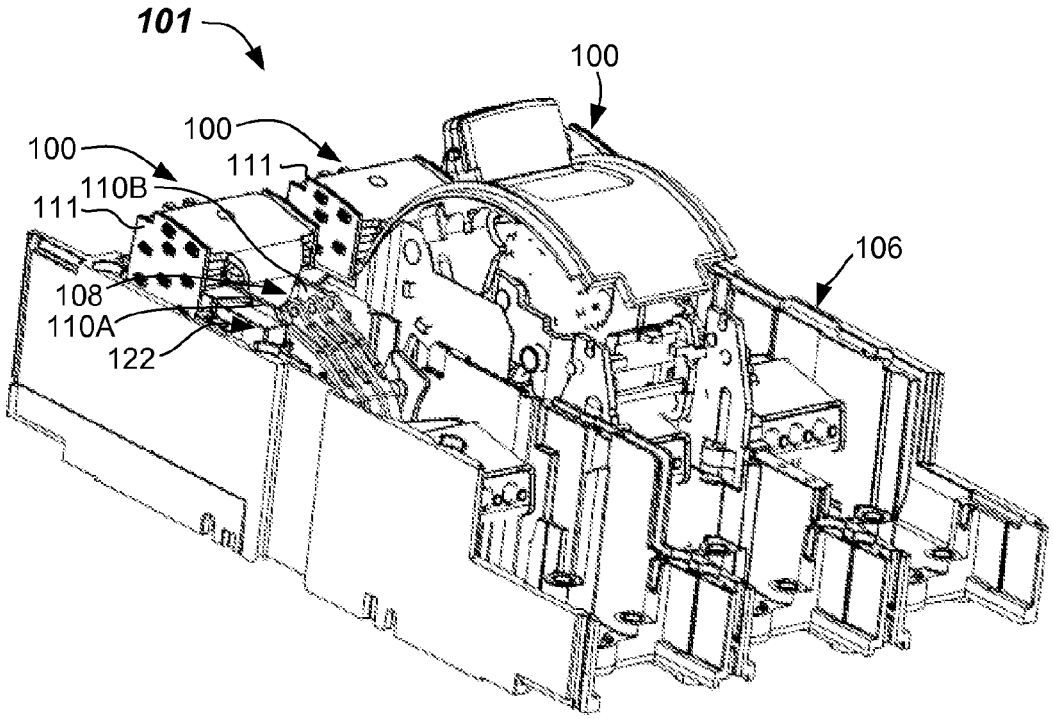
FIG. 1G illustrates an isometric view of a contact assembly including multiple arc extinguishing assemblies according to one or more embodiments.

For example, FIG. 1G illustrates a contact assembly 101 including three arc extinguishing assemblies 100 oriented in a side-by side configuration. In the depicted embodiment of the contact assembly 101, the three arc extinguishing assemblies 100 may be identical to one another, and each one may be adapted to receive a single phase provided from a polyphase electrical power distribution system (not shown). Contact assembly 101 for a three-phase circuit breaker is shown, but various embodiments are equally adapted for use with single phase systems and other multi-phase systems, or the like. Likewise, more than one contact arm 102 may be provided in each arc extinguishing assembly 100, as is shown. Three contact arms 102 are shown, but more or less numbers of contact arms may be employed.

Referring again to FIGS. 1A-1C, arc extinguishing assembly 100 may include an arc chamber 108 having an arc chamber width (b), wherein the arc chamber width (b) is measured adjacent to a contact arm tip 102E of a contact arm 102. In the depicted embodiment, the arc chamber width (b) is measured between inside surfaces of respective outgassing spacers 110A, 110B, as shown in FIGS. 1A and 1B.

Arc extinguishing assembly 100 may further include an arc chute assembly 111 that further includes stacked arc plates 112A-112J located at a forward end of the arc chamber 108 adjacent to the contact arm tip 102E of the one or more contact arms 102. The stacked arc plates 112A-112J may have a thickness of between about 1 mm and 4 mm, and a width between side plates 117A, 117B of less than about 50 mm, or even less than 30 mm in some embodiments. For example, the arc plate thickness may be about 1.5 mm and arc plate width may be about 24 mm in some embodiments. Other thicknesses and widths may be used. Furthermore, other numbers of arc plates may be used. Arc plates 112A-112J may be made of a steel material, such as low carbon steel or oth3er suitable material.

Arc chute assembly 111 may further include arc runner 114 below the lower arc plate 112A, and an arc horn 116 above the upper arc plate 112J. Each of the arc plates 112A-112J, arc runner 114, and arc horn 116 may be fastened to side plates 117A, 117B, which may be made from a fiberglass glass polyester sheet material, such as National Electrical Manufacturers Association (NEMA) grade GPO-3 material. Other suitable materials may be used. The arc plates 112A-112J, arc runner 114, and arc horn 116 may be attached to the side plates 117A, 117B by tabs. In some embodiments, the arc runner 114 may optionally be attached to the line side terminal 105, such as by one or more fasteners (e.g., screws or bolts). The attachment to the side plates 117A, 117B may be by crimping to deform a portion of the tabs, such as by use of a suitable crimping die or other crimping or deforming means. Further description of the arc plates 112A-112J, arc runner 114, and arc horn 116 may be found in U.S. patent application Ser. No. 14/371,770 entitled "SLOT MOTOR, SLOT MOTOR COVER, SLOT MOTOR—ARC PLATE ASSEMBLY, AND METHODS OF OPERATION, which is hereby incorporated by reference herein. Arc chute assembly 111 may reside within, and be contained in the pocket formed in the housing 106.

The arc extinguishing assembly 100 may further include a first fin feature 118A and a second fin feature 118B located at the forward end of the arc chamber 108 between the arc plates 112A-112J and the contact arm tip 102E. The first fin feature 118A includes first inner edge 120A and the second fin feature 118B includes a second inner edge 120B. First and second inner edges 120A, 120B may be parallel to one another. First inner edge 120A and the second inner edge 120B are spaced apart from one another by a spacing distance (a) as shown in FIG. 1A, and create an gas passage opening there between. The lengths of the respective first fin feature 118A and a second fin feature 118B are selected to provide a venturi ratio of a/b that is equal to or less than 0.6. In other embodiments, the venturi ratio of a/b is equal to or less than 0.5, equal to or less than 0.4, equal to or less than 0.2, or equal to or less than 0.15. In some embodiments, the venturi ratio of a/b is equal to or less than 0.6 but greater than or equal to 0.1.

Arc extinguishing assembly 100 may optionally include a slot motor 122 in some embodiments. Slot motor 122 may include a first side 122A and a second side 122B spaced apart from the first side 122A, as shown herein. Slot motor 122 may include a bottom side 122C extending between the first side 122A and a second side 122B, thereby providing a magnetic circuit. The first side 122A, second side 122B, and bottom side 122C of the slot motor 122 may each include a core 124 of a magnetically permeable material, such as steel (e.g., powdered metal or laminated plates), and a coating 126 of an insulating material, such as an epoxy layer, to prevent arcing to the core 124. Coating 126 may have a generally-uniform nominal layer thickness of less than about 2 mm, or even less than about 1 mm in some embodiments. Other thickness and insulating materials may be used. Further, other configurations and materials of the cores may be used.

Cores 124 may comprise a powdered metal material in one or more embodiments. The powdered metal material may be a powdered iron, such as F-0000-10, F-0000-15, or F-0000-20 powdered iron per MPIF Standard 35. The density of the powdered metal material may be between about 6.0 g/cm$^3$ and about 7.5 g/cm$^3$, for example. Other densities and types of powdered metal including powdered metal alloys may be used. The cores 124 of the slot motor 122 including a powdered metal may be formed by a conventional pressing and sintering process.

The slot motor 122 functions to intensify a magnetic field crossing through the one or more contact arms 102 during a short circuit event. This increases the magnetic repulsion force on the contact arms 102, so that the one or more contact arms 102 blow open more quickly. By quickly lengthening a distance between the moving electrical contact 103M and the stationary electrical contact 103S, a rapid increase in an opposing arc voltage is caused, which tends to more rapidly extinguish the arc. Furthermore, the slot motor 122 functions to intensify a magnetic field crossing through the electric arc. This increases the magnetic arc forces tending to drive the arc into the arc plates 122A-122J of the arc chute assembly 111 more rapidly.

In one or more embodiments, the first outgassing spacer 110A includes the first fin feature 118A coupled thereto at a forward end, and the body of the first outgassing spacer 110A and the first fin feature 118A may be one integral piece, such as is shown in FIG. 1D. Likewise, second outgassing spacer 110B includes a body and the second fin feature 118B, and they also may be one integral piece. The outgassing spacers 110A, 110B may include clearance recesses 119 to provide clearance for the contact arms 102 in some embodiments. As depicted in FIGS. 1A-1E, the outgassing spacers 110A, 110B and fin features 118A, 118B may be made of an outgassing material, such as an ablative plastic material. Nylon 6, 6 is one suitable material, for example. Nylon 6,6 is a polyamide material made from hexamethylenediamine and adipic acid. Other suitable ablative or outgassing materials may be used. In some embodiments, the polymer may be glass-filled or mineral-filled. For example, Nylon 6, 6 including fill of about 25% fiberglass by volume may be used. Further, in some embodiments, a flame retardant additive may be included in the base polymer. The outgassing materials may function to outgas water vapor and possibly a flame retardant in the presence of an arc.

As shown in FIGS. 1A and 1C, at least a portion of the fin features 118A, 118B may be received behind an extending tongue 116T of the arc horn 116. As best shown in FIGS. 1E and 1F, first fin feature 118A may include a first lower taper 130LA wherein the fin feature 118A tapers from a larger dimension proximate the first outgassing spacer 110A to a smaller dimension proximate the inner edge 120A.

Likewise, second fin feature 118B may include a second lower taper 130LB. First lower taper 130LA and second lower taper 130LB may each include a lower taper angle 132 of between about 5 degrees and 75 degrees, or between 10 degrees and 60 degrees in some embodiments, as best shown in FIGS. 1E and 1F. Lower taper angle 132 is measured between the respective first lower taper 130LA or second lower taper 130LB and a horizontal plane 134.

Similarly, first fin feature 118A may include first upper taper 130UA wherein the first fin feature 118A tapers from a larger dimension proximate the outgassing spacer 110A to a smaller dimension proximate the inner edge 120A. Likewise, second fin feature 118B may include a second upper taper 130UB. First upper taper 130UA and second upper taper 130UB may each include an upper taper angle 136 of between about 0 degrees and 45 degrees, or between 0 degrees and 35 degrees in some embodiments, as shown in FIGS. 1E and 1F. Upper taper angle 136 is measured between the respective first upper taper 130UA or second upper taper 130UB and a second horizontal plane 138.

In the depicted embodiment, the fin features 118A, 118B may be integral with the outgassing spacers 110A, 110B, but optionally may be mechanically fastened to the outgassing spacers 110A, 110B, such as with rivets. The outgassing spacers 110A, 110B may be plates.

As shown in FIGS. 1A and 1C, the intersection of the inner edges 120A, 120B with the first and second lower tapers 130LA, 130LB may be located below the lower end of the tongue 116T of the arc horn 116. The intersection may be a distance d of at least 1.0 mm below the below the lower end of the tongue 116T, and between about 1 mm and about 12 mm below in some embodiments, for example. The larger the number of contact arms 102 per phase, the distance d may be made larger. According to one or more embodiments, each of the fin features 118A, 118B may be positioned at least partially behind the tongue 116T, i.e., between the tongue 116T and the stack of arc plates 112A-112J. Functionally this is believed to limit arcing directly from the arc plates 112A-112J to the contact arm 102.

As shown in FIG. 1B, the fin features 118A, 118B may be aligned parallel to and along the front edges of the arc plates 112F-112I, and may be angled relative to the inside walls of the outgassing spacers 110A, 110B at an obtuse angle 128 of between about 120 and about 170 degrees, and between about 130 and about 160 degrees in some embodiments. Fin features 118A, 118B may have a thickness of between about 1 mm and about 3 mm, and between about 1.5 mm and about 2 mm in some embodiments, for example. Other thicknesses may be used. The fin features 118A, 118B may include a tapered thickness in some embodiments. The length of each fin feature 118A, 118B may be set to achieve the desired venturi ratio a/b being less than or equal to 0.6. The lengths of each of the first and second fin features 118A, 118B may be equal in one or more embodiments. Likewise the shapes of the first and second fin features 118A, 118B may be substantially the same.

FIG. 1G illustrates an isometric view of an embodiment of a contact assembly 101 including multiple (e.g., three) side-by-side oriented arc extinguishing assemblies 100 housed within a housing 106. The arc extinguishing assemblies 100 may each include an arc chute assembly 111, as described with reference to FIGS. 1A-1F. In this embodiment, each of the arc extinguishing assemblies 100 includes a slot motor 122 and outgassing spacers 110A, 110B located on opposite sides of the arc chamber 108.

As is shown in FIG. 1D, the first outgassing spacer 110A (outgassing spacer 110B being a mirror image thereof) includes a first fin feature 118A coupled thereto (e.g., molded therewith and an integral piece). First fin feature 118A may be as previously described. The outgassing spacer 110A may include a foot support 121 projecting forward of the front edge 123. The outgassing spacer 110A may include a retaining pin 125 configured to be received in a hole formed in the slot motor 122.

Figure 2:
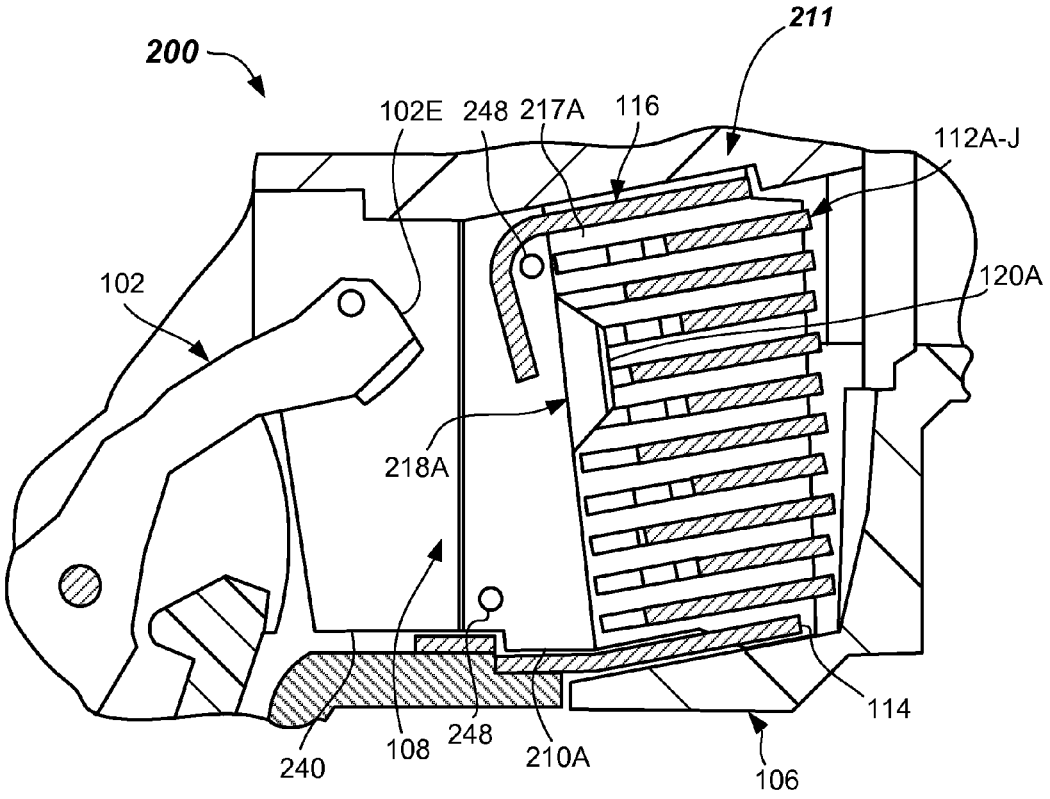
FIG. 2 illustrates a cross-sectioned partial side view of an arc extinguishing assembly including fin features and an outgassing spacer coupled to a side plate of an arc chute assembly according to one or more embodiments

FIG. 2 illustrates another alternate embodiment of arc extinguishing assembly 200. Arc extinguishing assembly 200 includes an arc chute assembly 211 including first outgassing spacer 210A including a first fin feature 218A formed thereon, wherein the outgassing spacer 210A is shown attached to a side plate 217A of the arc chute assembly 211. Attachment may be by rivets 248 or the like. The second outgassing spacer including the second fin feature (not shown) is a mirror image of the first outgassing spacer 210A including the first fin feature 218A, and may also be attached to a side plate of the arc chute assembly 211. The various tapers, angles, and thicknesses of the first fin feature 218A and second fin feature (not shown) may be the same as previously described. An optional spacer block 240, which may be made from an outgassing material, may be provided adjacent to but not attached to the outgassing spacer 210A, and likewise to the second outgassing spacer (not shown in FIG. 2).

Figure 3A:
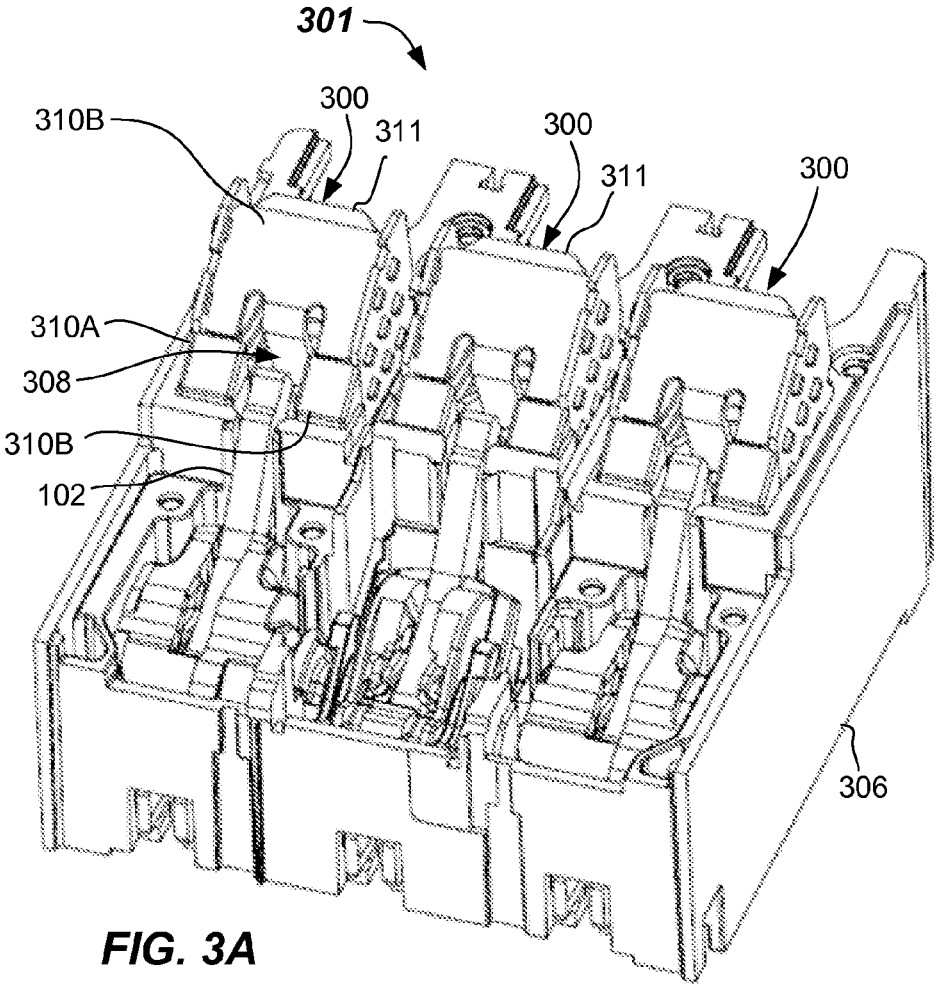
FIG. 3A illustrates an isometric view of a contact assembly including multiple arc extinguishing assemblies according to one or more embodiments.

FIG. 3A illustrates an isometric view of another embodiment of a contact assembly 301 including multiple (e.g., three) side-by-side oriented arc extinguishing assemblies 300 housed within a housing 306. This embodiment includes a single contact arm per phase. The arc extinguishing assemblies 300 may each (only one being labeled) include an arc chute assembly 311, similar as those described with reference to FIGS. 1A-1F. In this embodiment, each of the arc extinguishing assemblies 300 does not include a slot motor 122, but just outgassing spacers 310A, 310B located on opposite sides of the arc chamber 308. The outgassing spacers 310A, 310B may be made thicker than in the previous embodiment.

Figure 3B:
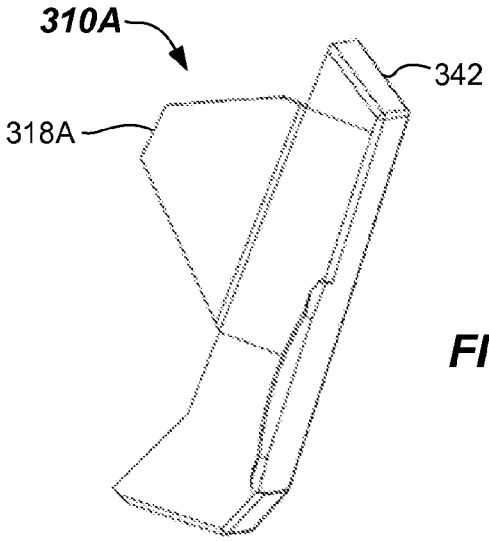
FIG. 3B illustrates an isometric view of an outgassing spacer with an integral fin feature of an arc extinguishing assembly according to one or more embodiments.

As is shown in FIG. 3B, the first outgassing spacer 310A (outgassing spacer 310B being a mirror image thereof) includes a fin feature 318A coupled to the outgassing spacer 310A. Fin feature 318A may be as previously described. Block body 342 may be made from an outgassing material and may have a length of about 10 mm, width of about 8 mm and height of about 50 mm, for example. Other dimensions may be used.

Figure 4:
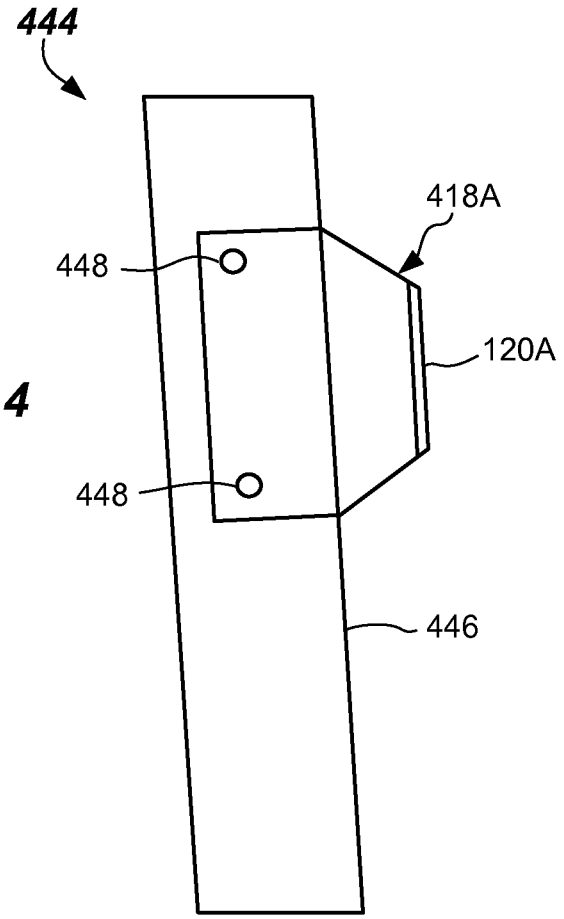
FIG. 4 illustrates a side plan view of a fin and support assembly including a fin feature of an arc extinguishing assembly according to one or more embodiments.

FIG. 4 illustrates an embodiment of a first fin and support assembly 444 including a first support 446 and a first fin feature 418A. The fin feature 418A may be coupled to the first support 446 or otherwise supported, such as by rivets 448 or other suitable fastening means. First support 446 of first fin and support assembly 444 may be fastened to a side plate (e.g., like side plate 217A) of an arc chute assembly, or otherwise be coupled to the housing or a slot motor on a side of the arc chamber 108. The side plate may itself support the first fin feature 418A. As shown, the first support 446 may be made from a non-outgassing material, whereas the first fin feature 418A may be made from an outgassing material like those materials discussed above. Non-outgassing material may be, meta-aramid paper material such as a NOMEX® material available from DuPont, for example. Other suitable non-outgassing high-temperature polymer materials or non-outgassing insulating materials may be used. A second fin and support assembly may be provided on the other side of the arc chamber 108 and the second fin and support assembly may be a mirror image of the first fin and support assembly 444 that is shown. Likewise, the second support may be made from a non-outgassing material, and the second fin feature may be made from an outgassing material. In some embodiments, the first support 446 may be sandwiched between the side plate and the first fin feature 418A. Thus, the side plate may support the first support 446 and the first fin feature 418A.

Figure 5:
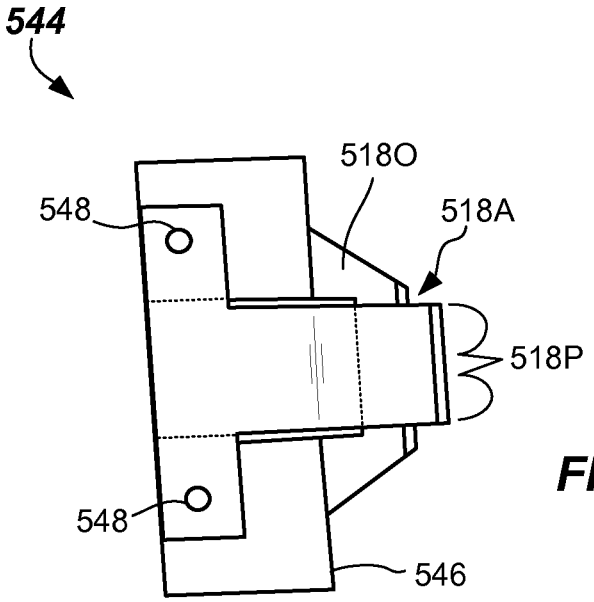
FIG. 5 illustrates a side plan view of a fin and support assembly including a fin feature of an arc extinguishing assembly according to one or more embodiments.

FIG. 5 illustrates another embodiment of fin and support assembly 544. In this embodiment, only a part 518P of the fin feature 518A comprises an outgassing material, whereas at least one other part (e.g., other part 5180) may be made from a non-outgassing material. The part 518P may at least partially overly the other part 5180 in some embodiments. The first support 546 and the other part 5180 may be integrally formed in some embodiments. A fin and support assembly 544 may be fastened on either side of the arc chamber 108, such as by rivets 548, and may be fastened to the side plates 117A, 117B, for example. In some embodiments the first fin feature 518A is rigid enough to support itself, such as by having a portion fastened to the side plate. In some embodiments, the first support 546 may be sandwiched between the part 518P and the side plate. Thus, the first support 546 may be at least partially supported by the side plate, and in some embodiments, the first fin feature may be at least partially supported by the other part 5180.

The other components of a circuit breaker including contact arms 102 are not shown and may be of conventional construction, or as shown in WO 2011/097612 entitled "Circuit Breaker Contact Assembly, And Systems and Methods Using Same," which is hereby incorporated by reference herein.

Figure 6:
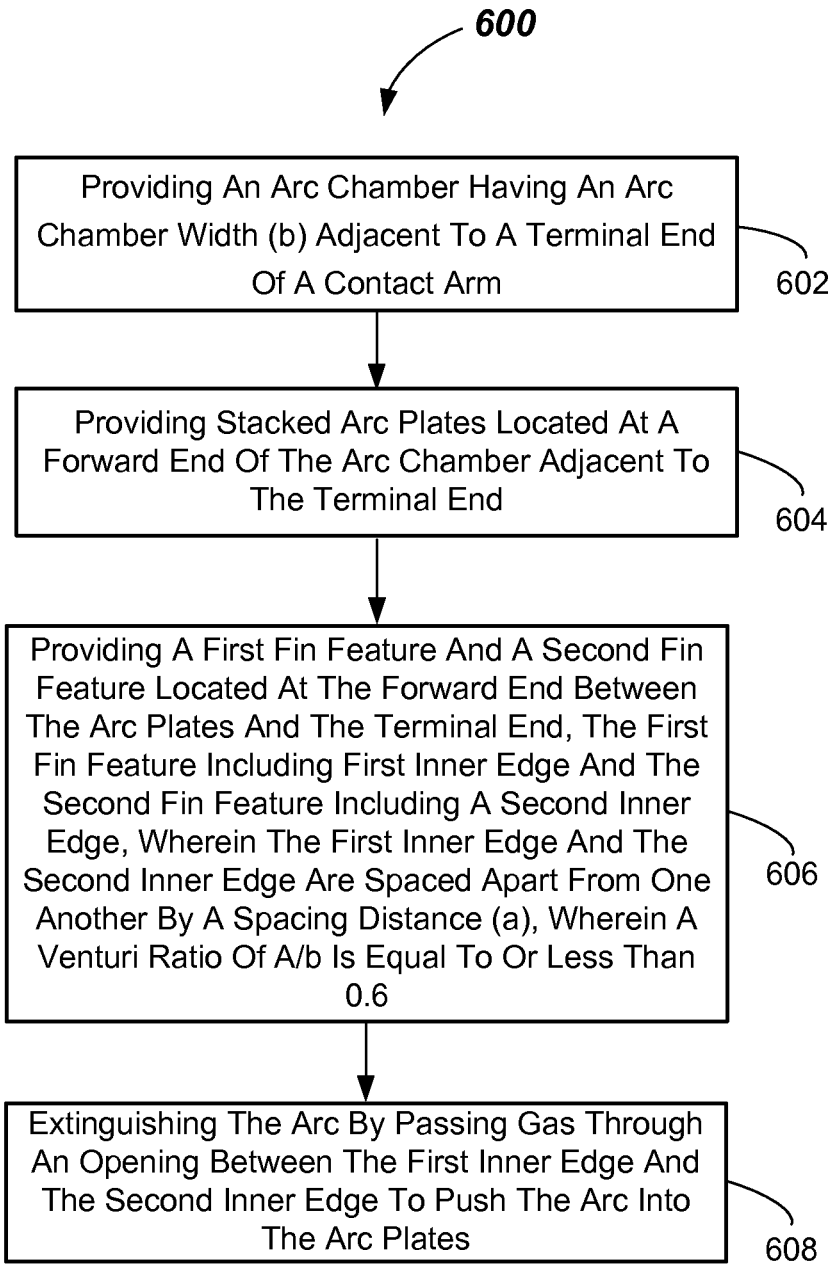
FIG. 6 illustrates a flowchart of a method of extinguishing an arc with an arc extinguishing assembly according to embodiments.

FIG. 6 illustrates a flowchart of a method of extinguishing an arc with an arc extinguishing assembly (e.g., arc extinguishing assembly 100, 200, 300) according to one or more embodiments. The method 600 includes, in 602, providing an arc chamber (e.g., arc chamber 108, 308) having an arc chamber width (b) located adjacent to a contact arm tip (e.g., contact arm tip 102E) of a contact arm (e.g., contact arm 102), and, in 604, providing stacked arc plates (e.g., stacked arc plates 112A-112J) located at a forward end of the arc chamber adjacent to the contact arm tip. More or less numbers of arc plates may be used.

The method 600 includes, in 606, providing a first fin feature (e.g., first fin feature 118A) and a second fin feature (e.g., second fin feature 118B) located at the forward end between the arc plates and the contact arm tip, the first fin feature including first inner edge (e.g., first inner edge 120A) and the second fin feature including a second inner edge (e.g., second inner edge 120B), wherein the first inner edge and the second inner edge are spaced apart from one another by a spacing distance (a) to form an opening, wherein a venturi ratio of a/b is equal to or less than 0.6. Reducing the spacing between the respective inner edges 120A, 120B in comparison to the arc chamber width (b) functions to create a larger gas pressure that causes the arc to remain on the arc plates 112A-112J and then jump to the arc horn 116.

The method 600 includes, in 608, extinguishing the arc by passing gas through an opening between the first inner edge (e.g., first inner edge 120A) and the second inner edge (e.g., 120B) to push the arc into the arc plates. The close spacing of the fin features 118A, 118B channels the arc through the opening and especially into the upper arc plates (e.g., arc plates 112H, 112I, and 112J), for example.

While the invention is susceptible to various modifications and alternative forms, specific embodiments and methods thereof have been shown by way of example in the drawings and are described in detail herein. It should be understood, however, that it is not intended to limit the invention to the particular apparatus, assemblies, or methods disclosed, but, to the contrary, the intention is to cover all modifications, equivalents, and alternatives falling within the scope of the appended claims.

What is claimed is:

1. An arc extinguishing assembly, comprising:

an arc chamber having an arc chamber width (b) adjacent to a contact arm tip of a contact arm;

stacked arc plates located at a forward end of the arc chamber adjacent to the contact arm tip; and a first fin feature and a second fin feature located at the forward end between the arc plates and the contact arm tip, the first fin feature including a first inner edge and the second fin feature including a second inner edge, wherein the first inner edge and the second inner edge are spaced apart from one another by a spacing distance (a), wherein a venturi ratio indicative of a tubular length of varying diameter of a/b is equal to or less than 0.6, wherein the first fin feature comprises a first upper taper and the second fin feature comprises a second upper taper.

2. The arc extinguishing assembly of claim 1, wherein the venturi ratio of a/b is equal to or less than 0.5.

3. The arc extinguishing assembly of claim 1, wherein the venturi ratio of a/b is equal to or less than 0.4.

4. The arc extinguishing assembly of claim 1, wherein the venturi ratio of a/b is equal to or less than 0.2.

5. The arc extinguishing assembly of claim 1, wherein the venturi ratio of a/b is equal to or less than 0.15.

6. The arc extinguishing assembly of claim 1, wherein the venturi ratio of a/b is equal to or less than 0.6 but greater than or equal to 0.1.

7. The arc extinguishing assembly of claim 1, comprising a first outgassing spacer and a second outgassing spacer wherein the first outgassing spacer includes the first fin feature formed thereon, and the second outgassing spacer includes the second fin feature formed thereon.

8. The arc extinguishing assembly of claim 1, wherein the first fin feature comprises a first lower taper and the second fin feature comprises a second lower taper.

9. The arc extinguishing assembly of claim 8, wherein an intersection of the first lower taper with the first inner edge and intersection of the second lower taper with the second inner edge are positioned a distance d from a lower edge of an arc horn, wherein the distance d is greater than 1.0 mm.

10. The arc extinguishing assembly of claim 9, wherein the distance d is between 1 mm and 12 mm.

11. The arc extinguishing assembly of claim 8, wherein the first lower taper and the second lower taper each include a lower taper angle of between 10 degrees and 70 degrees, measured between the respective first lower taper and the second lower taper and a horizontal plane.

12. The arc extinguishing assembly of claim 1, wherein the first upper taper and the second upper taper each include an upper taper angle of between 0 degrees and 45 degrees, measured between the respective first upper taper and the second upper taper and a second horizontal plane.

13. The arc extinguishing assembly of claim 1, comprising a first outgassing spacer including the first fin feature formed thereon, wherein the outgassing spacer is attached to a side plate of an arc chute assembly.

14. The arc extinguishing assembly of claim 1, comprising a first outgassing spacer block including a block body and the fin feature coupled to the block body.

15. An arc extinguishing assembly of claim 1, wherein the first fin feature and the second fin feature are part of opposing first fin and support assembly and second fin and support assembly, the first fin and support assembly including a first support wherein the first fin feature is coupled to the first support and the second fin and support assembly including a second support wherein the second fin feature is coupled to the second support, and wherein the first support and the second support are made from a non-outgassing material, and the first fin feature and the second fin feature are made from an outgassing material.

16. An arc extinguishing assembly of claim 1, comprising only a part of the first fin feature and the second fin feature comprises an outgassing material, whereas at least one other part of the first fin feature and second fin feature is made from a non-outgassing material.

17. An arc extinguishing assembly, comprising:

an arc chamber having an arc chamber width (b) adjacent to a contact arm tip of a contact arm;

stacked arc plates located at a forward end of the arc chamber adjacent to the contact arm tip;

an arc horn located above the stacked arc plates, the arc horn including a tongue;

a first outgassing spacer and a second outgassing spacer positioned on opposing sides of the arc chamber; and a first fin feature and a second fin feature located at the forward end between the arc plates and the contact arm tip and positioned at least partially behind the tongue, the first fin feature including first inner edge and the second fin feature including a second inner edge, wherein the first inner edge and the second inner edge are spaced apart from one another by a spacing distance (a), wherein a venturi ratio indicative of a tubular length of varying diameter of a/b is equal to or less than 0.6, and wherein the first fin feature is integral with the first outgassing spacer and the second fin feature is integral with the second outgassing spacer, wherein the first fin feature comprises a first upper taper and the second fin feature comprises a second upper taper.

18. A method of extinguishing an arc, comprising:

providing an arc chamber having an arc chamber width (b) adjacent to a contact arm tip of a contact arm;

providing stacked arc plates located at a forward end of the arc chamber adjacent to the contact arm tip;

providing a first fin feature and a second fin feature located at the forward end between the arc plates and the contact arm tip, the first fin feature including first inner edge and the second fin feature including a second inner edge, wherein the first inner edge and the second inner edge are spaced apart from one another by a spacing distance (a), wherein a venturi ratio indicative of a tubular length of varying diameter of a/b is equal to or less than 0.6, wherein the first fin feature comprises a first upper taper and the second fin feature comprises a second upper taper; and extinguishing the arc by passing gas through an opening between the first inner edge and the second inner edge to push the arc into the arc plates.

* * * * *